US008657974B1

(12) United States Patent
Mayville et al.

(10) Patent No.: US 8,657,974 B1
(45) Date of Patent: Feb. 25, 2014

(54) GAS GENERATOR

(75) Inventors: Brian A. Mayville, Troy, MI (US); Deborah L. Hordos, Troy, MI (US); Graylon K. Williams, Warren, MI (US)

(73) Assignee: TK Holdings, Inc., Armada, MI (US)

( * ) Notice: Subject to any disclaimer, the term of this patent is extended or adjusted under 35 U.S.C. 154(b) by 470 days.

(21) Appl. No.: 12/873,311

(22) Filed: Aug. 31, 2010

Related U.S. Application Data

(60) Provisional application No. 61/275,655, filed on Aug. 31, 2009.

(51) Int. Cl.

| | |
|---|---|
| ***C06B 45/00*** | (2006.01) |
| ***C06B 45/12*** | (2006.01) |
| ***C06B 45/14*** | (2006.01) |
| ***C06B 31/00*** | (2006.01) |
| ***C06B 31/08*** | (2006.01) |
| ***D03D 23/00*** | (2006.01) |
| ***D03D 43/00*** | (2006.01) |

(52) U.S. Cl.
USPC ..... 149/2; 149/14; 149/15; 149/45; 149/46; 149/109.4

(58) Field of Classification Search
USPC ..... 149/2, 14, 15, 45, 46, 109.4
See application file for complete search history.

(56) References Cited

U.S. PATENT DOCUMENTS

| | | | | |
|---|---|---|---|---|
| 2007/0034307 | A1* | 2/2007 | Hordos | 149/36 |
| 2007/0044675 | A1* | 3/2007 | Burns et al. | 102/530 |
| 2010/0194085 | A1* | 8/2010 | Mayville et al. | 280/741 |

* cited by examiner

*Primary Examiner* — James McDonough
(74) *Attorney, Agent, or Firm* — L.C. Begin & Associates, PLLC.

(57) ABSTRACT

A gas generator 10 includes an auto-ignition/booster composition 212 that contains a metal chlorate such as potassium chlorate as an oxidizer, a carboxylic acid such as DL-tartaric acid as a primary fuel, a secondary oxidizer such as strontium nitrate, and if desired, a secondary fuel such as 5-aminotetrazole. The auto-ignition/booster composition 212 and a separate provision of ammonium nitrate or phase stabilized ammonium nitrate 228 are provided within a single combustion/decomposition chamber 222 for the production of gas, upon actuation of the gas generator 10. Vehicle occupant protection systems 180, containing the gas generator 10, are also provided.

14 Claims, 4 Drawing Sheets

GAS GENERATOR

CROSS-REFERENCE TO RELATED APPLICATIONS

This application claims the benefit of U.S. Provisional Application Ser. No. 61/275,655 filed on Aug. 31, 2009, herein incorporated by reference in its entirety.

TECHNICAL FIELD

The present invention relates generally to gas generating systems, and to auto-ignition, booster, and gas generating compositions employed in gas generator devices for automotive restraint systems, for example.

BACKGROUND OF THE INVENTION

The present invention relates to auto-ignition, booster, and primary gas generating compositions. As known in the art, gas generators are typically provided with an auto-ignition composition that in the event of a fire ignites responsive to a desired threshold temperature. As a result, the primary gas generant is ignited prior to melting for example, thereby safely igniting the primary gas generant composition to inhibit or prevent the likelihood of an explosive event once the gas generant begins to combust. Another composition typically employed is the booster composition, functioning to rapidly increase the pressure in the gas generator so that a primary gas generating composition burns with optimum efficiency. Of course, the primary gas generating composition is employed as its name indicates: for production of useful amounts of gas in any vehicular protective context for example, such as airbags, seatbelt pretensioners, and so forth. Other gas generating applications are also contemplated as will be appreciated by those of ordinary skill in the art.

An ongoing challenge is to simplify the manufacture of a gas generator by reducing the constituents required in the production thereof. As explained above, in many gas generators used in vehicle occupant protection systems, several discrete compositions are provided to serve correspondingly discrete functions. These compositions often include a primary gas generating composition that when combusted is employed to provide sufficient quantities of gaseous products to operate the associated restraint device, such as an airbag or seatbelt pretensioner. A booster composition is utilized to elevate the pressure and heat within the gas generator prior to combustion of the primary gas generant, thereby creating favorable conditions within the inflator for acceptable combustion of the primary gas generant. Of course, still yet another composition is the auto-ignition composition employed to provide safe combustion of the other compositions in the event of a fire. The auto-ignition composition is designed to ignite at temperatures below the melting point of the primary gas generant for example, thereby ensuring the controlled combustion of the primary gas generant, as opposed to an explosive reaction perhaps.

The use of potassium chlorate within an auto-ignition composition has been considered given the auto-ignition properties of this oxidizer. Furthermore, carboxylic acid in combination with potassium chlorate typically provides a desired auto-ignition temperature of 200 degrees Celsius or less. Nevertheless, these types of compositions typically do not provide anything but auto-ignition function when employed in gas generators used in vehicle occupant protection systems, for example.

SUMMARY OF THE INVENTION

The above-referenced concerns and others may be resolved by gas generating systems including an auto-ignition/booster (AIB) composition containing a first oxidizer selected from metal chlorates, such as potassium chlorate, a carboxylic acid or dicarboxylic acid as a primary fuel, a secondary oxidizer selected from metal and nonmetal nitrates, nitrites, oxides, basic metal nitrates, and other known oxidizers, and a secondary fuel selected from azoles including tetrazoles, triazoles, and furazans, and salts thereof. Other constituents including extrusion aids, such as fumed silica and/or graphite, may be included in relatively small amounts.

In further accordance with the present invention, a gas generator and a vehicle occupant protection system incorporating the auto-ignition system are also included.

In yet another aspect of the invention, the present auto-ignition/booster compositions described herein, and other similar compositions, are provided in a gas generator. An ammonium nitrate supply is also included separately from, but juxtaposed alongside the auto-ignition/booster (AIB) composition, and is arranged to advantageously harness the heat and pressure from the AIB composition. Alternatively, the ammonium nitrate may be intermixed amongst the pellets or shaped charges of the AIB composition. Upon exposure to the heat, the ammonium nitrate decomposes to provide pyrotechnic gases at exit temperatures substantially lower than typical gases generated from state-of-the-art gas generating compositions.

DETAILED DESCRIPTION OF THE PREFERRED EMBODIMENT(S)

Figure 1:
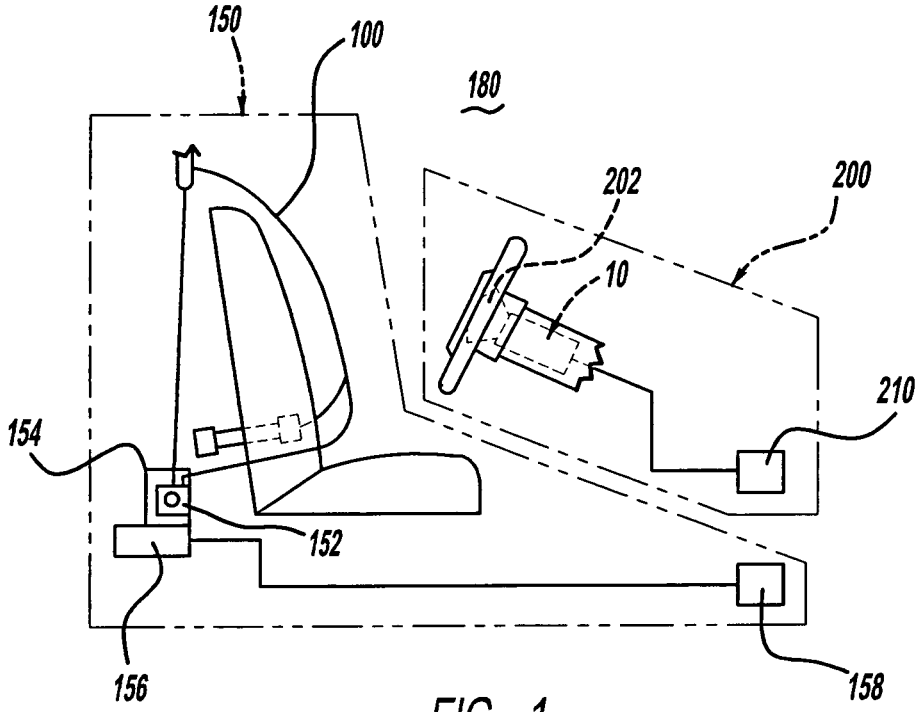
FIG. 1 is a schematic representation of an exemplary vehicle occupant restraint system containing an auto-ignition/booster composition, and ammonium nitrate or phase stabilized ammonium nitrate, in accordance with the present invention.

The present auto-ignition/booster compositions contain a first oxidizer selected from alkali, alkaline earth, and transitional metal chlorates, and mixtures thereof, such as potassium chlorate, at about 10-60 weight %; a primary fuel selected from carboxylic acids and dicarboxylic acids, such as DL-tartaric acid, at about 15-45 weight %; a secondary oxidizer selected from metal and nonmetal nitrates, nitrites, oxides, and other known oxidizers at about 30-50%; and a secondary fuel selected from tetrazoles, triazoles, furazans, and salts thereof at about 0-30 weight %, said weight percent calculated with regard to the weight of the total composition. Extrusion aids or processing additives such as graphite or fumed silica may be added in relatively smaller amounts, such as 0.1-2% by weight of the total composition for example.

The present auto-ignition/booster (AIB) compositions may contain a metal chlorate such as potassium chlorate; a primary fuel selected from carboxylic acids and dicarboxylic including DL-tartaric acid, L-tartaric acid, D-tartaric acid, succinic acid, glutamic acid, adipic acid, mucic acid, fumaric acid, oxalic acid, galactaric acid, citric acid, glycolic acid, L-malic acid, and compounds having at least one—COOH—group, and mixtures thereof; a second fuel selected from an azole including tetrazoles, triazoles, furazans, salts thereof, and mixtures thereof; a secondary oxidizer selected from metal and nonmetal nitrates or other known oxidizers not containing a perchlorate. The carboxylic acid or dicarboxylic acid will preferably have a primary hydrogen or PKA less than or equal to 3. Nevertheless, it has been found that with certain fuels/salts, the pKa of the base acid may range up to 5.0 or less.

In one embodiment, the total fuel constituent including the carboxylic fuel and the second fuel is provided at about 20-45% by weight of the total composition; the oxidizer constituent is provided at about 20-50% by weight of the total composition; and the potassium chlorate or metal chlorate is provided at about 10-60% by weight of the total composition wherein the weight percent of the chlorate is separately calculated from that of the oxidizer. The composition may be formed by wet or dry mixing the constituents in a granulated form in a known manner, and then pelletizing or otherwise forming the composition for further use. The constituents may be provided by Fisher Chemical, Aldrich Chemical, GFS, and other known suppliers. It will be appreciated that other auto-ignition/booster compositions as known in the art may also be employed in accordance with the present invention.

The benefits of the present AIB compositions are exemplified by the following Examples:

Comparative Example 1

A known auto-ignition composition was prepared by homogeneously mixing dried and granulated D-glucose at about 26.875 wt % and potassium chlorate at about 73.125 wt %, the percents stated by weight of the total composition. The composition autoignited at about 144 C as measured by DSC analysis. The propellant formed from the constituents resulted in an approximate 55.5% gas yield. The impact sensitivity of this formulation had an HD50 of 2.0 inches as conducted in conformance with the Bruceton Test.

Example 2

An exemplary formulation was provided that functions as a booster, an auto-ignition, and a gas generant composition. The formulation contains 5-aminotetrazole at about 19.0 wt %, DL-tartaric acid at about 20.0 wt %, strontium nitrate at about 35.0 wt %, and potassium chlorate at about 26.0 wt %. The constituents were previously and separately ground to a relatively small size in a known manner. They were then dry-mixed to form a substantially homogeneous composition. The composition autoignited at about 140 C. as measured by DSC analysis. The propellant formed from the constituents resulted in an approximate 67% gas yield. The impact sensitivity of this formulation had an HD50 of 11.5 inches as conducted in conformance with the Bruceton Test. The composition was aged for about 480 hours at 107 C and still autoignited at about 145.1 C as determined by DSC analysis.

Example 3

Figure 3:
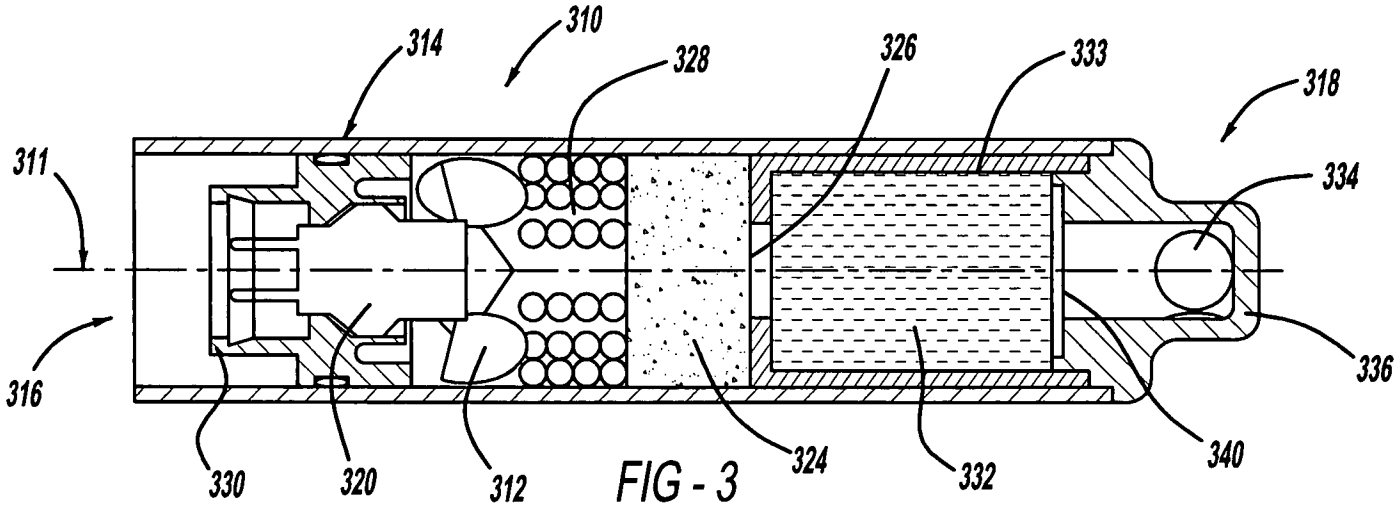
FIG. 3 illustrates a cross-section of one embodiment of an inflator incorporating an AIB composition, and an ammonium nitrate or phase stabilized ammonium nitrate supply, with a reduced filter, all three within a single combustion/decomposition chamber; and a coolant section.

An exemplary formulation was provided that functions as a booster, an auto-ignition, and a gas generant composition. The formulation contains 5-aminotetrazole at about 19.0 wt %, DL-tartaric acid at about 19.0 wt %, strontium nitrate at about 50.0 wt %, and potassium chlorate at about 12.0 wt %. The constituents were granulated and dry-mixed to form a substantially homogeneous composition. The composition autoignited at about 141 C as measured by DSC analysis. The propellant formed from the constituents resulted in an approximate 68.2% gas yield. The impact sensitivity of this formulation had an HD50 of 8.8 inches as conducted in conformance with the Bruceton Test. As shown in FIG. 3, the composition reflected a relatively strong burn rate across several pressure regimes, and in particular indicated burn rates of over 0.8 inches per second (ips). Again referring to FIG. 3, it can be seen that the composition exhibited a burn rate of about 0.2 ips at about 200 psig, about 0.35 ips at about 550 psig, about 0.5 ips at about 1000 psig, about 0.55 ips at about 1500 psig, about 0.85 ips at about 2000 psig, about 0.9 ips at about 2500 psig, about 0.85 ips at about 3000 psig; and about 1.2 ips at about 3900 psig. It can therefore be seen that a composition in accordance with the present invention exhibits a satisfactory burn rate (typically 0.4 ips or more at about 2500-3000 psig) thereby ensuring satisfactory functionality as a primary gas generant. The composition was aged for about 480 hours at 107 C and still autoignited at about 174.7 C as determined by DSC analysis.

Example 4

An exemplary formulation was provided that functions as a booster, an auto-ignition, and a gas generant composition. The formulation contains DL-tartaric acid at about 28.0 wt %, strontium nitrate at about 32.0 wt %, and potassium chlorate at about 30.0 wt %. The constituents were previously and separately ground to a relatively small size in a known manner. They were then dry-mixed to form a substantially homogeneous composition. The composition autoignited at about 153 C as measured by DSC analysis. The propellant formed from the constituents resulted in an approximate 66.1% gas yield. The impact sensitivity of this formulation had an HD50 of 8.1 inches as conducted in conformance with the Bruceton Test.

As indicates in Examples 1-4, compositions formed in accordance with the present invention (Examples 2-4) preferably autoignite at or below about 180 C and provide a booster function as well. The compositions of the present invention may also produce substantial quantities of gas, and exhibit sufficient burn rates thereby producing sufficient amounts of gas when activated. Compositions employing a secondary oxidizer, such as strontium nitrate, provide relative increased quantities of gas and an improved sensitivity. A Bruceton sensitivity result wherein $H_{50}$=3.9 or more relaxes the packaging requirements as per U.S.D.O.T regulations. Accordingly, compositions having a sensitivity result of 3.9 or greater provide substantial packaging advantages. It will further be appreciated that the use of a secondary fuel, such as 5-aminotetrazole, in conjunction with the carboxylic or dicarboxylic acid, the secondary oxidizer, and the potassium chlorate produces greater amounts of gas, acceptable auto-ignition temperatures, and booster functionality. As such, compositions formed in this manner may be provided to singularly replace the three discrete booster, auto-ignition, and primary gas generant compositions normally found in a gas generator. In particular, and as described below, the discrete or separable use of ammonium nitrate or phase stabilized ammonium nitrate with the present AIB compositions results in relatively greater amounts of gas without the need of mixing ammonium nitrate or phase stabilized ammonium nitrate in with the AIB compositions. As a result, concerns normally attendant with the use of ammonium nitrate or phase stabilized ammonium nitrate including phase stability and/or thermal stability, are not implicated because ammonium nitrate is provided "neat" alongside the present compositions. When the geometry of the ammonium nitrate must be retained to ensure repeatability of performance and other performance objectives, phase stabilized ammonium nitrate pressed into tablets or wafers is employed to ensure retention of the respective shape of the phase stabilized ammonium nitrate. It will be appreciated that phase stabilized ammonium nitrate (PSAN) may be provided as known in the art. For example, the ammonium nitrate may be stabilized by co-precipitating 10-15 weight percent of potassium nitrate within the ammonium nitrate. Other potassium-containing constituents may also be employed for this purpose, as may other phase stabilization constituents and methods known to those of ordinary skill.

Examples 5-16

As shown in Table 1 below, the various acids shown, when converted to salts and mixed with potassium chlorate in stoichiometric amounts exhibit acceptable auto-ignition temperatures for a variety of uses. Certain auto-ignition temperatures exceed 180 C but may still be useful in selected applications such as hybrid inflators and seatbelt pretensioners for example. It will be appreciated that these Examples reflect the auto-ignition character imparted by the resulting salts and the potassium chlorate. As further shown, acids exhibiting a pKa of about 3.05 or less generally provide auto-ignition temperatures generally less than 170-180 C. However, acids exhibiting a pKa of about 5.0 or less may still be acceptable wherein auto-ignition temperatures of 250 or so are acceptable, for example. It will be appreciated that certain acids such as citric acid and malonic acid when stoichiometrically combined with potassium chlorate may not satisfy the auto-ignition function, but still when combined with at least a second oxidizer may function as a booster oxidizer and a primary gas generant. It has further been determined that the use of a desiccant as described in co-owned and co-pending U.S. Ser. No. 11/479,493, herein incorporated by reference, may in certain circumstances maintain optimum environmental conditions within the gas generator thereby facilitating the tri-functionality of the composition when used as an auto-ignition, booster, and primary gas generating composition.

TABLE 1

| | | | Stoichiometric Mixture w KC | | |
|---|---|---|---|---|---|
| Name | Structure | Lit. mp | DSC/TGA | Hot Plate | PKa |
| L-Tartaric Acid | 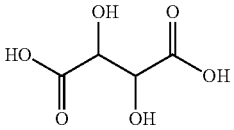 | 168-170 | Al 142 | 154 | 3.02 |
| D-Tartaric Acid | | 168-170 | | | 2.98 |
| DL-Tartaric Acid | | 206 | Al 171 | 185 | |
| Meso-Tartaric Acid | | 140 | | | 3.22 |
| Succinic Acid | 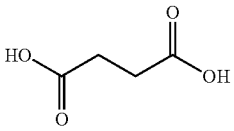 | 188-190 | mp 184 followed by small exo; no TGA step function | 210 | 4.16 |
| Diglycolic Acid | 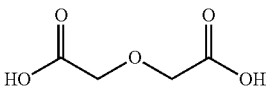 | 142-145 | mp 130 followed by small exo; TGA slow dec. | 155 | 3.28 |

TABLE 1-continued

| Name | Structure | Lit. mp | Stoichiometric Mixture w KC DSC/TGA | Hot Plate | PKa |
|---|---|---|---|---|---|
| Malonic Acid | 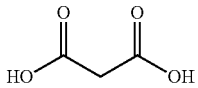 | 135-137 | mp 124 followed by small exo; TGA slow dec. | >250 | 2.83 |
| Trans-Glutaconic Acid | 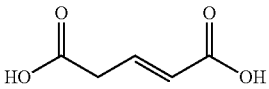 | 137-139 | mp 136; Al 166 | 188 | |
| D-Glutamic Acid | 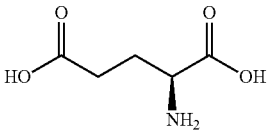 | 200-202 | mp 206; Al 213 | 235 | 2.13 |
| Adipic Acid | 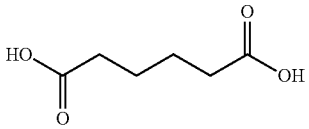 | 152-154 | mp 153; Al 222 | 237 | 4.43 |
| Mucic Acid | 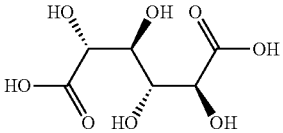 | 215 | Al 200 | 223 | 3.08 |
| Citric Acid | 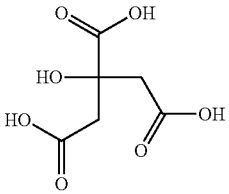 | 152-154 | mp 141 followed by small exo; no TGA step function | >250 | 3.12 |

It will be appreciated that in further accordance with the present invention, gas generators made as known in the art and also vehicle occupant protection systems manufactured as known in the art are also contemplated. As such, auto-ignition/booster compositions of the present invention are employed in gas generators, seat belt assemblies, and/or vehicle occupant protection systems, all manufactured as known in the art.

Figure 2:
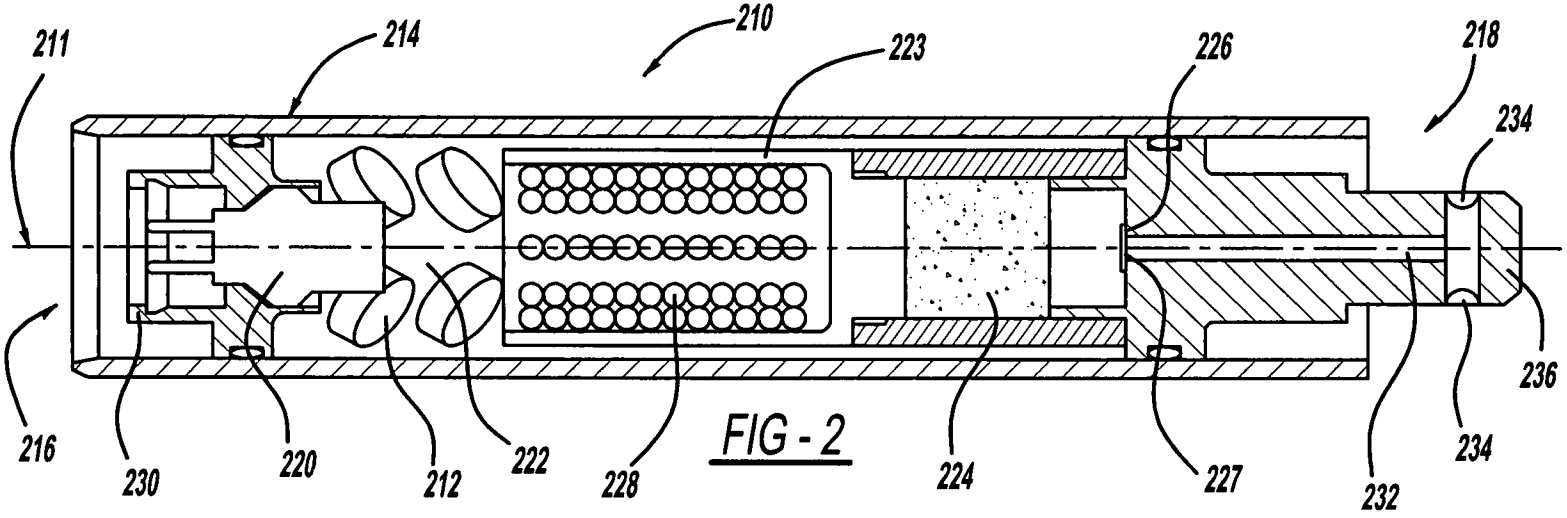
FIG. 2 illustrates a cross-section of yet another embodiment of an inflator incorporating ammonium nitrate or phase stabilized ammonium nitrate within a cup, juxtaposed to an AIB composition, and a filter, all contained within a single combustion/decomposition chamber wherein the inflator gases are shunted for higher pressure applications.

In yet another aspect of the invention, the present compositions may be employed within a gas generating system. For example, as schematically shown in FIG. 2, a vehicle occupant protection system made in a known way contains crash sensors in electrical communication with an airbag inflator in the steering wheel, and also with a seatbelt assembly. The gas generating compositions of the present invention may be employed in both subassemblies within the broader vehicle occupant protection system or gas generating system. More specifically, each gas generator employed in the automotive gas generating system may contain a gas generating composition as described herein.

Extrusion aides may be selected from the group including talc, graphite, borazine [$(BN)_3$], boron nitride, fumed silica, and fumed alumina. The extrusion aid preferably constitutes 0-10% and more preferably constitutes 0-5% of the total composition.

The compositions may be dry or wet mixed using methods known in the art. The various constituents are generally provided in particulate form and mixed to form a uniform mixture with the other gas generant constituents.

It should be noted that all percents given herein are weight percents based on the total weight of the gas generant composition. The chemicals described herein may be supplied by companies such as Aldrich Chemical Company for example.

Referring now to FIG. 1, the exemplary inflator 10 may also be incorporated into an airbag system 200. Airbag system 200 includes at least one airbag 202 and an inflator/gas generator 10 containing an auto-ignition/booster/gas generant composition 12 in accordance with the present invention, coupled to airbag 202 so as to enable fluid communication with an interior of the airbag. Airbag system 200 may also include (or be in communication with) a crash event sensor 208. Crash event sensor 208 includes a known crash sensor algorithm that signals actuation of airbag system 200 via, for example, activation of airbag inflator 10 in the event of a collision.

Referring again to FIG. 1, airbag system 200 may also be incorporated into a broader, more comprehensive vehicle occupant restraint system 180 including additional elements such as a safety belt assembly 150. FIG. 2 shows a schematic diagram of one exemplary embodiment of such a restraint system. Safety belt assembly 150 includes a safety belt housing 152 and a safety belt 100 extending from housing 152. A safety belt retractor mechanism 154 (for example, a spring-loaded mechanism) may be coupled to an end portion of the belt. In addition, a safety belt pretensioner 156 containing auto-ignition/booster composition 12 may be coupled to belt retractor mechanism 154 to actuate the retractor mechanism in the event of a collision. Typical seat belt retractor mechanisms which may be used in conjunction with the safety belt embodiments of the present invention are described in U.S. Pat. Nos. 5,743,480, 5,553,803, 5,667,161, 5,451,008, 4,558,832 and 4,597,546, each incorporated herein by reference. Illustrative examples of typical pretensioners with which the safety belt embodiments of the present invention may be combined are described in U.S. Pat. Nos. 6,505,790 and 6,419,177, incorporated herein by reference.

Safety belt assembly 150 may also include (or be in communication with) a crash event sensor 158 (for example, an inertia sensor or an accelerometer) including a known crash sensor algorithm that signals actuation of belt pretensioner 156 via, for example, activation of a pyrotechnic igniter (not shown) incorporated into the pretensioner. U.S. Pat. Nos. 6,505,790 and 6,419,177, previously incorporated herein by reference, provide illustrative examples of pretensioners actuated in such a manner.

It should be appreciated that safety belt assembly 150, airbag system 200, and more broadly, vehicle occupant protection system 180 exemplify but do not limit gas generating systems contemplated in accordance with the present invention.

In further accordance with the present invention, FIGS. 2-7 illustrate yet further aspects of the present invention. In particular, it has been discovered that at relatively lower temperatures, those existing when the present AIB compositions are ignited and combusted, the ammonium nitrate begins to decompose and decomposition proceeds enthusiastically. As a result, a reduced filter may be used, and the complexity of the inflator 10 is reduced. Namely, the primary gas generating agent is ammonium nitrate, and its decomposition properties are advantageously utilized to produce useful amounts of relatively inexpensive gas, at cooler temperatures. As shown in the figures, the ammonium nitrate may be intermingled amongst the AIB composition, or, it may be provided separately, juxtaposed alongside the auto-ignition/booster composition, or within a cup or inner sleeve, for example. In all cases, the ammonium nitrate is in fluid communication with the AIB composition both before and after actuation of the systems 180 or 200, and gas generator 10.

Referring to FIG. 2, a gas generator 210 includes a housing or outer-body 214 having a first end 216 and a second end 218. An axis 211 extends longitudinally through the center of the housing 214 whereby the following description essentially describes the various constituents of the inflator 210 along the length or axis 211 of the inflator 210. An igniter 220 is fixed at first end 216 for ignition of an auto-ignition/booster (AIB) composition 212. A combustion/decomposition chamber 222 is formed within the housing 214 and contains the AIB composition 212. Juxtaposed alongside the AIB composition 212 is a supply of ammonium nitrate 228 that fluidly communicates with the combustion products of the AIB composition 212 upon actuation of the gas generator 210. As shown in FIG. 2, a perforate cup 223 houses the ammonium nitrate 228 within the combustion/decomposition chamber 222. An optional cylindrical expanded metal filter 224 is provided juxtaposed to the ammonium nitrate, whereby the ammonium nitrate 228 is longitudinally positioned between the AIB composition 212 and the filter 224. As shown, the shape of the filter 224 is cylindrical with a free volume formed by the inner diameter of the filter 224. The shape of the filter 224 may be determined by the structural architecture of the inside of the housing 214, particularly as defined by the shape of the cup 223. As shown in FIG. 2, and in accordance with the present invention, the chamber 222 contains the AIB composition 212, the ammonium nitrate 228, and the filter 224, all sealed within the single chamber 222 by burst shim 226 and the igniter/body bore seal 230. An orifice 227 is covered by the burst shim 226. A conduit 232 may be provided and upon gas generator actuation fluidly communicates with the orifice 227/chamber 222 and extends to the second end 218. A plurality of orifices 234 are formed within a nozzle 236 at the second end 218. Upon operation of the inflator 210, the igniter 220 is actuated based on a signal from a system algorithm (not shown), thereby igniting composition 212. As heat and pressure increase, the ammonium nitrate 228 begins to rapidly decompose. Upon an increase in pressure, shim 226 ruptures and combustion and decomposition gases then pass through the orifice 227, and into and through the conduit 232, and then exit the inflator 210 through the nozzle 236.

Referring to FIG. 3, a gas generator 310 includes a housing or outer-body 314 having a first end 316 and a second end 318. An axis 311 extends longitudinally through the center of the housing 314 whereby the following description essentially describes the various constituents of the inflator 310 along the length or axis 311 of the inflator 310. An igniter 320 is fixed at first end 316 for ignition of an auto-ignition/booster (AIB) composition 312. A combustion/decomposition chamber 322 is formed within housing 314 and contains the AIB composition 312. Juxtaposed alongside the AIB composition 312 is a supply of ammonium nitrate 328 that fluidly communicates with the combustion products of AIB composition 312 upon actuation of the gas generator 310. An optional filter 324 may be provided juxtaposed to the ammonium nitrate, whereby the ammonium nitrate 328 is longitudinally positioned between the AIB composition 312 and the filter 324. As shown in FIG. 3, and in accordance with the present invention, the chamber 322 contains the AIB composition 312, the ammonium nitrate 328, and the filter 324 all sealed within the single chamber 322 by a first burst shim 326 and the igniter/body bore seal 330. A coolant 332 may be provided near the second end 318 and juxtaposed to the filter 324.

Examples of suitable coolant mixtures are salt solutions, such as solutions containing metal salts. An aqueous salt solution is desired relative to reducing the freezing point of the coolant whereby the particular concentration of the aqueous salt solution may be varied depending on the freezing point of the respective coolant and the solids that would be contained upon vaporization of the associated water. Exemplary coolants include saline solutions containing alkali metal and alkaline earth metal formates, acetates, chlorides, and mixtures thereof. Other exemplary coolants include aqueous solutions of potassium formate, glycols such as propylene glycol, potassium acetate, and mixtures thereof, and alcohol solutions containing alcohols such as ethyl alcohol. The amount of coolant 332 used may be iteratively determined and varied depending on the thermodynamic properties inherent to the inflator, relative to the AIB composition 312 and any filter 324 that may be employed as a heat sink, for example. A sealed coolant cup 333 that is opened upon rupture of the first burst shim 326, may be used to house and utilize the coolant 332 in accordance with U.S. patent application Ser. No. 12/700,473, herein incorporated by reference in its entirety. As the cup 333 is opened upon rupture of the first burst shim 326, gases flow into the cooling cup 333 for cooling thereof, prior to exiting from the gas generator 310. As the coolant and gases migrate along axis 311 toward the second end 318, a second burst shim 340 is ruptured due to increased pressure, thereby releasing gases from the gas generator 310. It will be appreciated that liquid coolant 332 may be employed when additional cooling is required for air bag protection and/or surface temperature reduction.

A plurality of orifices 334 are formed within a nozzle 336 at the second end 318. Upon operation of the inflator 310, the igniter 320 is actuated based on a signal from a system algorithm (not shown), thereby igniting composition 312. As heat and pressure increase, the ammonium nitrate 328 begins to rapidly decompose. Upon an increase in pressure, shim 326 ruptures so that gases pass through into the filter 324 and then into the coolant 332. The combustion and decomposition gases then rupture the second burst shim 340, and then exit the inflator 310 through the nozzle 336.

Figure 4:
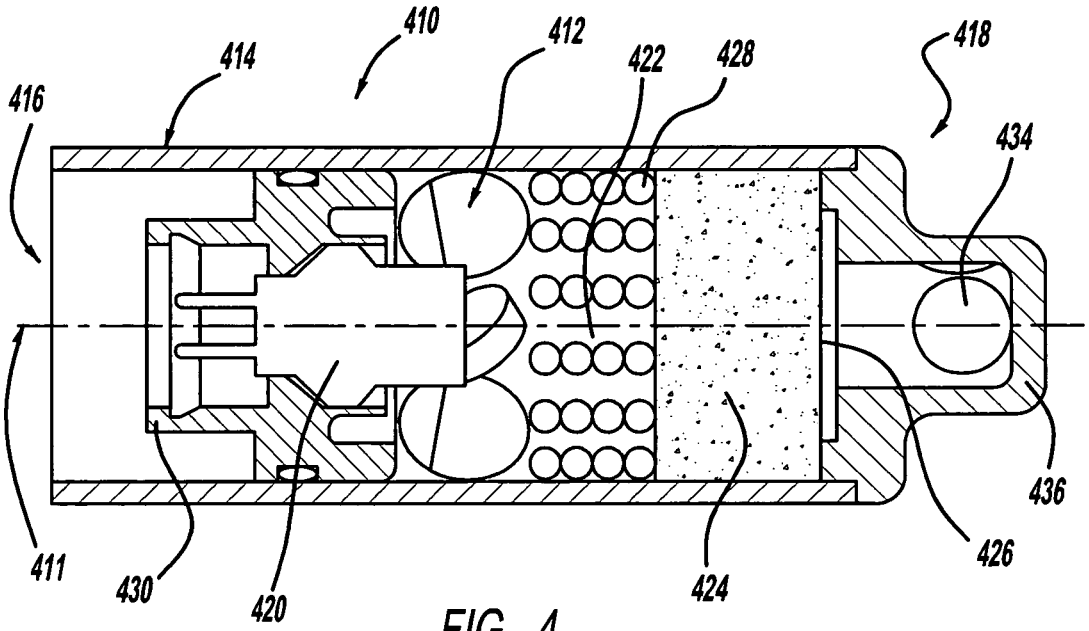
FIG. 4 illustrates a cross-section of yet another embodiment of an inflator incorporating an AIB composition, and an ammonium nitrate or phase stabilized ammonium nitrate supply, with a filter.

Referring to FIG. 4, a gas generator 410 includes a housing or outer-body 414 having a first end 416 and a second end 418. An axis 411 extends longitudinally through the center of the housing 414 whereby the following description essentially describes the various constituents of the inflator 410 along the length or axis 411 of the inflator 410. An igniter 420 is fixed at first end 416 for ignition of an auto-ignition/booster (AIB) composition 412. A combustion/decomposition chamber 422 is formed within housing 414 and contains the AIB composition 412. Juxtaposed alongside the AIB composition 412 is a supply of ammonium nitrate 428 that fluidly communicates with the combustion products of the AIB composition 412 upon actuation of the gas generator 410. An optional filter 424 is provided juxtaposed to the ammonium nitrate, whereby the ammonium nitrate 428 is longitudinally positioned between the AIB composition 412 and the filter 424. As shown in FIG. 4, and in accordance with the present invention, the chamber 422 contains the AIB composition 412, the ammonium nitrate 428, and the filter 424 all sealed within the single chamber 422 by burst shim 426 and the igniter/body bore seal 430. A plurality of orifices 434 are formed within a nozzle 436 at the second end 418. Upon operation of the inflator 410, the igniter 420 is actuated based on a signal from a system algorithm (not shown), thereby igniting composition 412. As heat and pressure increase, the ammonium nitrate 428 begins to rapidly decompose. Upon an increase in pressure, shim 426 ruptures so that gases pass through into the filter 424. The combustion and decomposition gases then exit the inflator 410 through the nozzle 436. An inflatable airbag may be attached to the gas outlet in a known manner.

Figure 5:
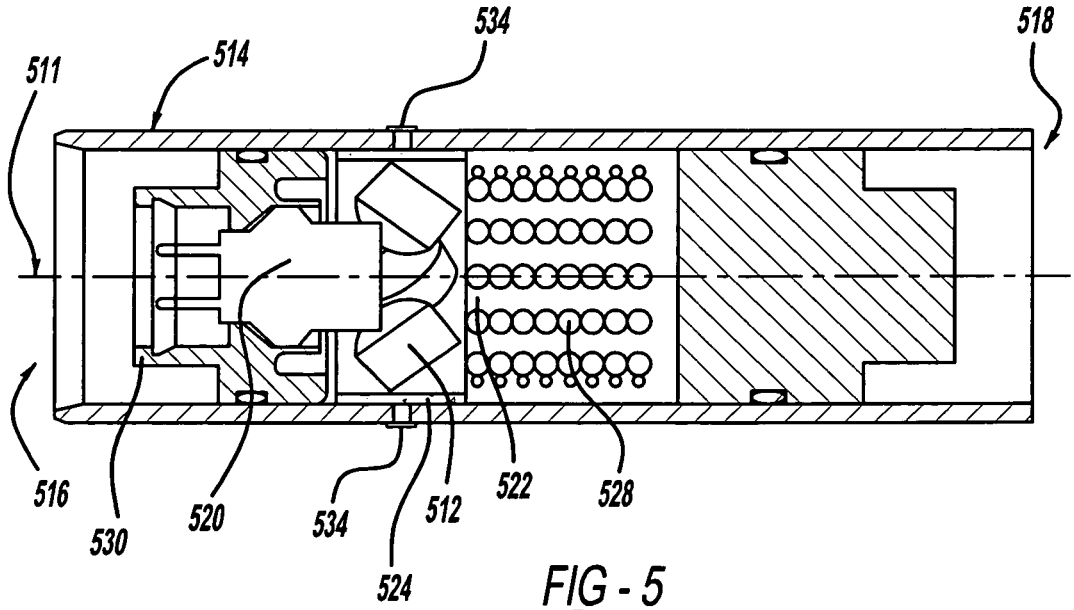
FIG. 5 illustrates a cross-section of yet another embodiment of an inflator incorporating an AIB composition, and an ammonium nitrate or phase stabilized ammonium nitrate supply, both incorporated within a single combustion/decomposition chamber, and absent a filter.

Referring to FIG. 5, a gas generator 510 includes a housing or outer-body 514 having a first end 516 and a second end 518. An axis 511 extends longitudinally through the center of the housing 514 whereby the following description essentially describes the various constituents of the inflator 510 along the length or axis 511 of the inflator 510. An igniter 520 is fixed at first end 516 for ignition of an auto-ignition/booster (AIB) composition 512. A combustion/decomposition chamber 522 is formed within housing 514 and contains the AIB composition 512. Juxtaposed alongside the AIB composition 512 is a supply of ammonium nitrate 528 that fluidly communicates with the combustion products of the AIB composition 512 upon actuation of the gas generator 510. As shown in FIG. 5, and in accordance with the present invention, the chamber 522 contains the AIB composition 512, and the ammonium nitrate 528, and the filter 524, both sealed within the single chamber 522 by end plug 526 and the igniter/body bore seal 530. A plurality of sealed orifices 534 are formed about the periphery of the chamber 522 thereby facilitating the gas exit through the orifices 534 and the housing 514. Upon operation of the inflator 510, the igniter 520 is actuated based on a signal from a system algorithm (not shown), thereby igniting composition 512. As heat and pressure increase, the ammonium nitrate 528 begins to rapidly decompose. Upon an increase in pressure, the shims or seals of the orifices 534 rupture so that combustion and decomposition gases pass through the orifices 534 and then radially exit the housing 514 and the inflator 510. An inflatable airbag may for example, be attached to the gas outlet in a known manner.

Figure 6:
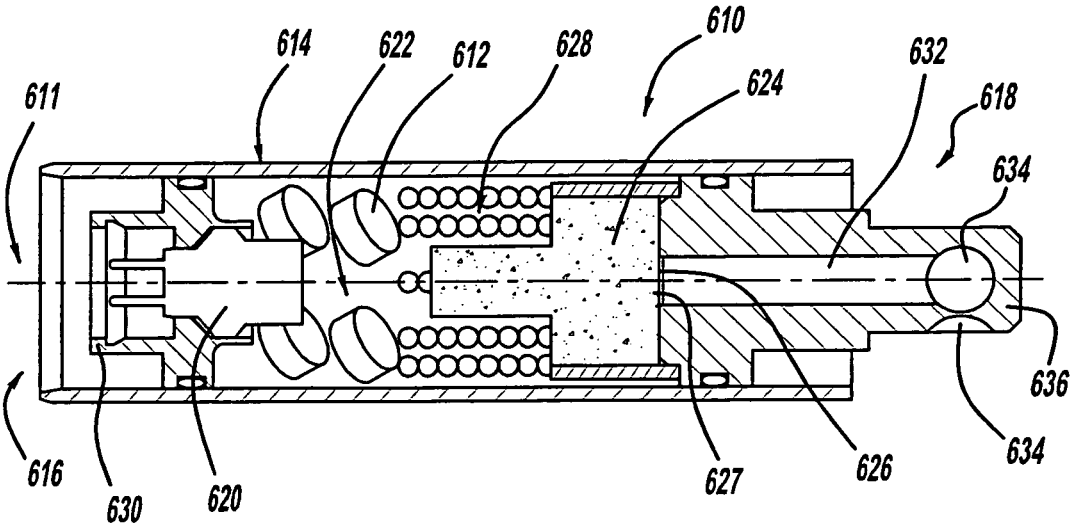
FIG. 6 illustrates a cross-section of yet another embodiment of an inflator incorporating an AIB composition, and an ammonium nitrate or phase stabilized ammonium nitrate supply, with a filter, all within the same combustion/decomposition chamber, wherein the inflator gases are shunted through a conduit to exit the inflator.

Referring to FIG. 6, a gas generator 610 includes a housing or outer-body 614 having a first end 616 and a second end 618. An axis 611 extends longitudinally through the center of the housing 614 whereby the following description essentially describes the various constituents of the inflator 610 along the length or axis 611 of the inflator 610. An igniter 620 is fixed at first end 616 for ignition of an auto-ignition/booster (AIB) composition 612. A combustion/decomposition chamber 622 is formed within housing 614 and contains the AIB composition 612. Juxtaposed alongside the AIB composition 612 is a supply of ammonium nitrate 628 that fluidly communicates with the combustion products of the AIB composition 612 upon actuation of the gas generator 610. An optional filter 624 is provided juxtaposed to the ammonium nitrate, whereby the ammonium nitrate 628 is longitudinally positioned between the AIB composition 612 and the filter 624. The filter 624 has an optimum and relatively larger surface area in direct contact with the phase stabilized ammonium nitrate or ammonium nitrate 628, thereby harnessing the benefit of the heat retained by the filter 624. Heat transfer from the filter 624 to the phase stabilized ammonium nitrate (PSAN) or ammonium nitrate 628 maximizes the decomposition of the PSAN or ammonium nitrate in contact therewith. As shown in FIG. 6, and in accordance with the present invention, the chamber 622 contains the AIB composition 612, the ammonium nitrate 628, and the filter 624, all sealed within the single chamber 622 by burst shim 626 and the igniter/body bore seal 630. An orifice 627 is covered by the burst shim 626. A conduit 632 may be provided and upon gas generator actuation fluidly communicates with the orifice 627/chamber 622 and extends to the second end 318. A plurality of orifices 634 are formed within a nozzle 636 at the second end 618. Upon operation of the inflator 610, the igniter 620 is actuated based on a signal from a system algorithm (not shown), thereby igniting composition 612. As heat and pressure increase, the ammonium nitrate 628 begins to rapidly decompose. Upon an increase in pressure, shim 626 ruptures and combustion and decomposition gases then pass through the orifice 627, and into and through the conduit 632, and then exit the inflator 610 through the nozzle 636.

Figure 7:
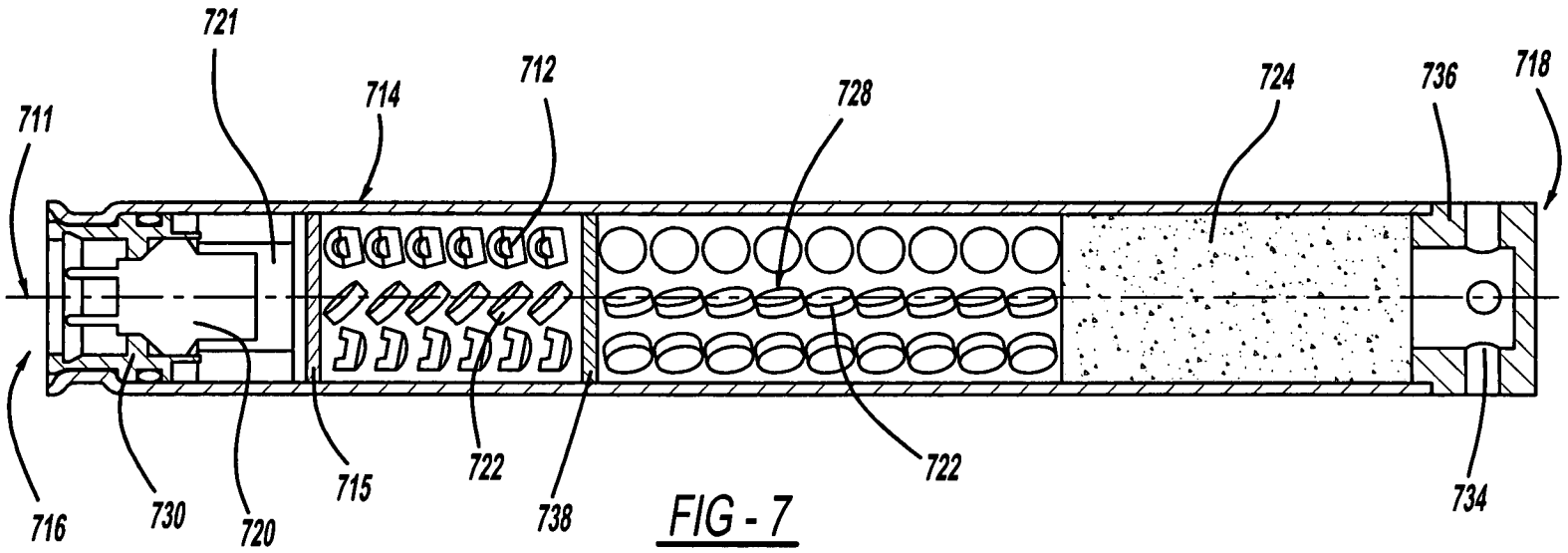
FIG. 7 illustrates a cross-section of yet another embodiment of an inflator incorporating an AIB composition, and a phase stabilized ammonium nitrate bed, with a filter, all within the same combustion/decomposition chamber.

Referring to FIG. 7, a gas generator 710 includes a housing or outer-body 714 having a first end 716 and a second end 718. An axis 711 extends longitudinally through the center of the housing 714 whereby the following description essentially describes the various constituents of the inflator 710 along the length or axis 711 of the inflator 710. An igniter or inititator 720 is fixed at first end 716 for ignition of an auto-ignition/booster (AIB) composition 712. A combustion/decomposition chamber 722 is formed within housing 714 and contains the AIB composition 712. Juxtaposed alongside the AIB composition 712 is a supply of phase stabilized ammonium nitrate 728 that fluidly communicates with the combustion products of the AIB composition 712 upon actuation of the gas generator 710. A first metallic or other suitable screen 715 separates the AIB bed 712 from the igniter 720 and the first end 716. A spring member 721 biases the first screen 715 against the AIB bed 712 and the ammonium nitrate bed 728 into a tighter collective pack. A second metallic screen 738 is placed between the AIB composition 712 and the ammonium nitrate 728 to prevent physical contact between the AIB bed 712 and the ammonium nitrate bed 728. Stated another way, the AIB bed 712 and the ammonium nitrate bed 728 are juxtaposed but in a separate and discrete relationship to each other, or, simply not mixed together nor in intimate physical contact. It has been discovered that in certain instances, intimate contact between the ammonium nitrate 728 and the AIB composition 712, or variations in the geometry of each, may affect performance. The embodiment of FIG. 7 therefore responds to this concern.

Referring again to FIG. 7, an optional filter 724 (e.g. a crushed wire filter) is provided in juxtaposition to the ammonium nitrate 728, whereby the ammonium nitrate 728 is longitudinally positioned between the AIB composition 712 and the filter 724. As shown in FIG. 7, and in accordance with the present invention, the chamber 722 contains the AIB composition 712, the phase stabilized ammonium nitrate 728, and the filter 724 all sealed within the single chamber 722 by burst shim 726 and the igniter/body bore seal 730. A plurality of orifices 734 are formed within a nozzle 736 at the second end 718. Upon operation of the inflator 710, the igniter 720 is actuated based on a signal from a system algorithm (not shown), thereby igniting composition 712. As heat and pressure increase, the ammonium nitrate 728 begins to rapidly decompose. Upon an increase in pressure, shim 726 ruptures so that gases pass through into the filter 724. The combustion and decomposition gases then exit the inflator 710 through the nozzle 736. An inflatable airbag may be attached to the gas outlet in a known manner.

With all embodiments, the amount of ammonium nitrate or phase stabilized ammonium nitrate employed is iteratively determinative based on the thermodynamic properties inherent to the respective inflator, such as those exhibited by the AIB compositions and so forth, and, the total amount of gas desired. A thermodynamic balance may be iteratively evaluated by considering the heat of combustion of each mol of the AIB composition and providing sufficient heat to accommodate the heat of decomposition of each mol of ammonium nitrate or each mol of phase stabilized ammonium nitrate. Depending on the inflator and the AIB composition and geometry, for example, this evaluation may be iteratively conducted to ensure that sufficient amounts of gas are liberated from the primary gas source, ammonium nitrate. It will be appreciated that the present invention provides abundant amounts of gas while yet simplifying the inflator to one AIB composition and the juxtaposed ammonium nitrate. As a result, only one pressure chamber within the inflator is necessary, as compared to multi-pressure chambers when booster chambers and primary gas generant chambers are employed in comparative inflators. Furthermore, although it has not previously been appreciated that ammonium nitrate could non-invasively function within the same chamber as the AIB composition or even within a booster chamber, the present discovery results in substantial simplification of the inflator design due to a reduction in structure and seals, for example. Furthermore, the ability to enhance the production of gas with the use of ammonium nitrate or PSAN substantially reduces the handling and Department of Transportation requirements by reducing the sensitivity of the gas generating constituents overall.

Various constituents of the inflator may be made as generally known in the art, and/or as exemplified within the appended figures. For example, the housing may be stamped or extruded; the nozzle may be extruded or otherwise metal-formed to include the gas exit orifices; burst shim(s) may be welded over the orifice(s) to be sealed; the filter may be formed from wire mesh and supplied by companies such as Wayne Wire Cloth Products, Inc. of Kalkaska, Mich.; the initiator or igniter may be formed as known in the art and/or supplied by known suppliers, and sealed in position by the body bore subassembly. Exemplary igniter constructions are described in U.S. Pat. Nos. 6,009,809 and 5,934,705, incorporated herein by reference. It will be appreciated that various design criteria such as chamber pressure retention of about 20 MPa or greater, for example, is desired for a sufficiently extended time period to ensure decomposition of all of the PSAN or ammonium nitrate. The chamber pressure may be controlled by orifice size, AIB geometry, and AN/PSAN geometry for example.

The present description is for illustrative purposes only, and should not be construed to limit the breadth of the present invention in any way. Thus, those skilled in the art will appreciate that various modifications could be made to the presently disclosed embodiments without departing from the scope of the present invention as defined in the appended claims. For example, other AIB compositions that ignite at the aforementioned temperatures with the requisite energy/pressure may be used in accordance with the present invention. Furthermore, other inflator configurations utilizing the AIB/ammonium nitrate combination are also contemplated.

What is claimed is:

1. A gas generator comprising:

a housing;

a combustion/decomposition chamber within the housing;

an auto-ignition/booster composition contained within the combustion/decomposition chamber; and ammonium nitrate or phase stabilized ammonium nitrate contained as a neat compound within the combustion/decomposition chamber and in operable and vapor communication with said auto-ignition/booster composition, said ammonium nitrate or phase stabilized ammonium nitrate separate from but adjacent to said auto-ignition/booster composition;

wherein upon actuation of said gas generator, the auto-ignition/booster composition is ignitable to initiate decomposition of the ammonium nitrate or phase stabilized ammonium nitrate within the combustion/decomposition chamber.

2. A gas generator comprising:

a housing;

a combustion/decomposition chamber within the housing;

an auto-ignition/booster composition contained within the combustion/decomposition chamber; and ammonium nitrate or phase stabilized ammonium nitrate contained within the combustion/decomposition chamber and in vapor communication with said auto-ignition/booster composition, said ammonium nitrate or phase stabilized ammonium nitrate is provided neat and separate and discrete from but juxtaposed to said auto-ignition/booster composition.

3. The gas generator of claim 1 wherein said auto-ignition/booster composition contains:

a metal chlorate as a first oxidizer;

a primary fuel selected from carboxylic acids, dicarboxylic acids, and mixtures thereof; and a second oxidizer not having perchlorate character.

4. The auto-ignition/booster composition of claim 3 wherein said metal chlorate is provided at about 10-20 wt %, and said primary fuel is provided at about 15-45 wt %, and said second oxidizer is provided at about 30-50 wt %, said percentages stated by weight of the total composition.

5. The auto-ignition composition of claim 3 wherein said composition further comprises a secondary fuel selected from tetrazoles, triazoles, furazans, and salts thereof, said secondary fuel provided at about 0.1-30 wt %.

6. The auto-ignition/booster composition of claim 3 wherein said primary fuel is selected from tartaric acid and its isomers, succinic acid, glutamic acid, adipic acid, mucic acid, oxalic acid, malonic acid, fumaric acid, galactaric acid, glycolic acid, citric acid, L-malic acid, and mixtures thereof.

7. The composition of claim 6 comprising DL-tartaric acid at about 19-28 wt %, potassium chlorate at about 12-30 wt %, 5-aminotetrazole at about 15-25 wt %, and strontium nitrate at about 30-50 wt %, said percentages stated by weight of the total composition.

8. The composition of claim 3 wherein said secondary oxidizer is selected from metal, basic metal, and nonmetal nitrates, nitrites, oxides, and chlorates.

9. The gas generator of claim 1 further including a coolant for cooling of gases exiting from said combustion/decomposition chamber.

10. The gas generator of claim 9 wherein said coolant is selected from alkali metal and alkaline earth metal formates, acetates, and chlorides; glycols; alcohols; and mixtures thereof.

11. The gas generator of claim 10 wherein said coolant is selected from an aqueous solution of potassium formate, propylene glycol, potassium acetate, ethyl alcohol, and mixtures thereof.

12. The gas generator of claim 1 further including a filter for filtration of gases exiting from said decomposition/decomposition chamber.

13. The gas generator of claim 1 wherein said ammonium nitrate or phase stabilized ammonium nitrate is separate and discretely juxtaposed to said auto-ignition/booster composition.

14. The gas generator of claim 1 wherein said ammonium nitrate is interspersed within a bed of said auto-ignition/booster composition.

* * * * *